US006011316A

United States Patent [19]

Niimi

[11] Patent Number: 6,011,316

[45] Date of Patent: Jan. 4, 2000

[54] STARTER HAVING MAGNETIC SWITCH AND FIXING MEMBER FOR FIXING THE MAGNETIC SWITCH THEREIN

[75] Inventor: Masami Niimi, Handa, Japan

[73] Assignee: Denso Corporation, Kariya, Japan

[21] Appl. No.: 08/970,426

[22] Filed: Nov. 14, 1997

[30] Foreign Application Priority Data

Nov. 15, 1996 [JP] Japan ..... 8-304395
Oct. 8, 1997 [JP] Japan ..... 9-275645

[51] Int. Cl.[7] ..... F02N 11/00

[52] U.S. Cl. ..... 290/38 R; 74/6; 335/126

[58] Field of Search ..... 290/38 R, 38 A, 290/48; 74/6, 7 B, 7 R; 335/126, 131

[56] References Cited

U.S. PATENT DOCUMENTS 5,508,566 4/1996 Nagao et al. ..... 290/38 R
5,525,947 6/1996 Shiga et al. ..... 335/126
5,528,084 6/1996 Shiga et al. ..... 290/38 R
5,569,892 10/1996 Shiga et al. ..... 200/19 R
5,600,184 2/1997 Shiga et al. ..... 290/38 R
5,760,485 6/1998 Shiga et al. ..... 290/38 R
5,770,901 6/1998 Niimi et al. ..... 310/52
5,789,821 8/1998 Shiga et al. ..... 290/38 R

FOREIGN PATENT DOCUMENTS 61-93962 6/1986 Japan .
8-61196 3/1996 Japan .

*Primary Examiner*—Nicholas Ponomarenko
*Attorney, Agent, or Firm*—Pillsbury Madison & Sutro LLP

[57] ABSTRACT

A magnetic switch including a plunger is disposed on a rear end side of an armature via an end frame so that a moving direction of the plunger is perpendicular to an axial direction of the armature, and is fixed to the end frame by a fixing member. The fixing member is composed of a semi-circular portion having a shape corresponding to an outer circumference of the magnetic switch and arm portions extending from the semi-circular portion. Further, each of the arm portions has a deflection portion at an end thereof on a semi-circular portion side, and a claw portions at the opposite end (front end) thereof that is bent inward to be engaged with the end frame. When fixing the magnetic switch to the end frame, the deflection portion is deformed to have elasticity, and the claw portion is engaged with the end frame. As a result, the fixing member can easily and securely fix the magnetic switch to the end frame.

20 Claims, 4 Drawing Sheets

STARTER HAVING MAGNETIC SWITCH AND FIXING MEMBER FOR FIXING THE MAGNETIC SWITCH THEREIN

CROSS REFERENCE TO RELATED APPLICATIONS

This application is based upon and claims the benefit of priority of prior Japanese Patent Applications No. 8-304395 filed on Nov. 15, 1996, and No. 9-275645 filed on Oct. 8, 1997, the contents of which are incorporated herein by reference.

BACKGROUND OF THE INVENTION

1. Field of the Invention

The present invention relates to a starter for a vehicle that is used to start an internal combustion engine.

2. Related Arts

JP-A-8-61196 discloses a starter largely composed of a starter motor and a magnetic switch that is arranged at an axially rear side of the starter motor so that a plunger moving direction of the magnetic switch is generally perpendicular to an armature rotational axis of the starter motor. The size of this type of starter is small in comparison with a so-called biaxial type starter, and therefore mounting performance on an engine can be significantly improved. In the biaxial type starter, the magnetic switch is disposed on the outer side in the radial direction of the starter motor so that the plunger moving direction of the magnetic switch is parallel to the armature rotational axis of the starter motor.

On the other hand, as described above, the starter is largely composed of two components of the starter motor and the magnetic switch. Therefore, in view of durability, there is a case where one of the starter motor and the magnetic switch fails to operate properly, while the other is still operative. In such a case, in views of reducing cost and preventing waste of material, it is more advantageous to exchange only the inoperative one than to exchange the whole of the starter.

However, conventionally, the starter motor and the magnetic switch are fixed to each other by using a plurality of bolts. This structure make the above-described individual exchange of the starter motor and the magnetic switch difficult. In addition, to use the bolts, it is necessary to form a plurality of holes in the starter motor and in the magnetic switch for receiving the bolts, and to thread on inner circumferences of the holes to enable the bolts to be screwed in the holes. Further, when fastening the bolts, it needs time to control a fastening load and a fastening torque of the bolts, resulting in high cost.

SUMMARY OF THE INVENTION

The present invention has been made in view of the above-described problems and an object of the present invention is to provide a starter including a magnetic switch that is fixed in the starter without using any bolts and is capable of being easily dismounted from the starter for replacement. Specifically, the object of the present invention is to provide a starter composed of a starter motor and a magnetic switch that are arranged such that a plunger moving direction of the magnetic switch is perpendicular to an armature rotational axis of the starter motor, in which the magnetic switch is fixed in the starter without using any bolts and is capable of being easily dismounted from the starter.

According to the present invention, a fixing member fixes a magnetic switch to an end frame disposed between the magnetic switch and a starter motor while pushing the magnetic switch toward the end frame. Specifically, the fixing member has a holding portion for holding an outer circumference of the magnetic switch, an arm portion extending from the holding portion, and a deflection portion provided between the holding portion and the arm portion. In a state where the deflection portion has elasticity, a front end of the arm portion is engaged with the end frame. As a result, the magnetic switch can be easily fixed to the end frame without using any bolts, and easily dismounted from the end frame only by disengaging the front end of the arm portion of the fixing member from the end frame.

A resin member may be disposed between the magnetic switch and the end frame. In this case, the magnetic switch is fixed to the resin member as well as to the end frame. Preferably, at least one of the end frame, the resin member, and the fixing member has a restricting portion for restricting movement of the magnetic switch in an axial direction of the magnetic switch. More preferably, at least one of the end frame, the resin member, and the fixing member has a restricting portion for restricting movement of the magnetic switch in a circumferential direction of the magnetic switch. As a result, the rotation of the magnetic switch can be securely prevented.

Further, in a case where the starter motor includes an armature having a rotational shaft that is supported by a ball bearing at an end thereof, the front end of the arm portion of the fixing member engaged with the end frame can push the ball bearing in a direction parallel to the rotational shaft of the armature. Accordingly, pressure is applied to the ball bearing without any extra parts, so that an impact load applied to the ball bearing is reduced, resulting in improvement of lifetime of the ball bearing.

BRIEF DESCRIPTION OF THE DRAWINGS

Other objects and features of the present invention will become more readily apparent from a better understanding of the preferred embodiments described below with reference to the following drawings.

DETAILED DESCRIPTION OF THE PREFERRED EMBODIMENTS

Figure 1:
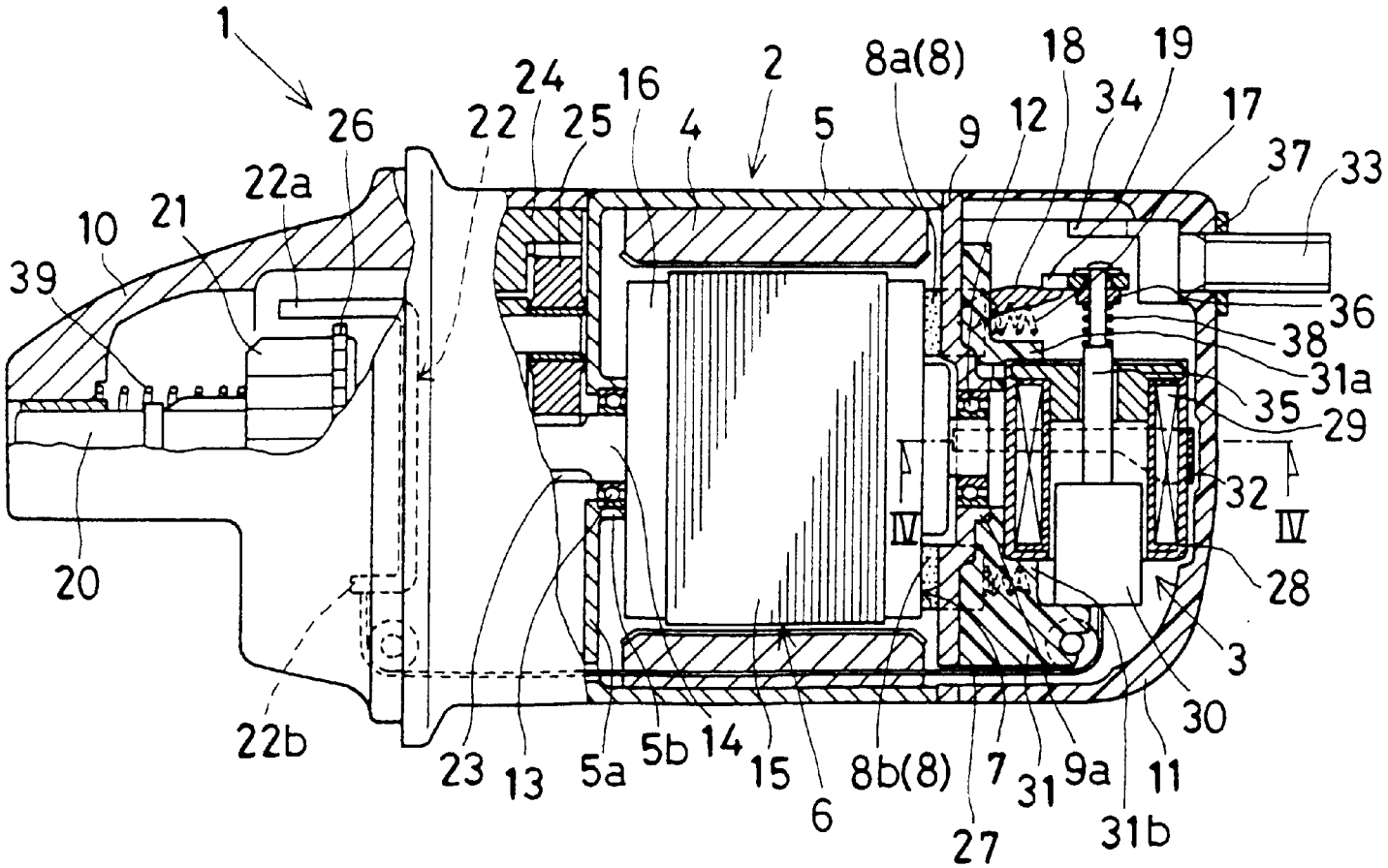
FIG. 1 is a side cross-sectional view showing a starter in a first preferred embodiment according to the present invention.

Embodiments according to the present invention will be described hereinunder with reference to the drawings.

First Embodiment

A starter illustrated in FIG. 1 has a starter motor 2 for generating a rotational force, a power transmission part (described later) for transmitting the rotational force of the starter motor 2 to a ring gear (not shown) of an engine, a magnetic switch 3 for controlling energization of the starter motor 2, and the like.

The starter motor 2 has a cylindrically shaped yoke 5 holding a magnetic field member 4 on an inner circumference thereof, an armature 6 rotatably supported in an inner circumference of the field member 4, a commutator 7 provided on an end portion in an axial direction of the armature 6, brushes 8 slidably contacting the commutator 7, and the like. The field member 4 is composed of a plurality of permanent magnets. The yoke 5 is manufactured by, for example, pressing (deeply drawing) metal into a cylindrical shape having a bottom face, and then is disposed between a housing 10 and an end cover 11 along with an end frame (partition member) 9. The end frame 9 is installed to abut the rear end surface (right axial end surface in FIG. 1) of the yoke 5. The front end wall 5*a* of the yoke 5 being the bottom face serves as a wall for partitioning the starter motor 2 and the power transmission part.

Figure 2:
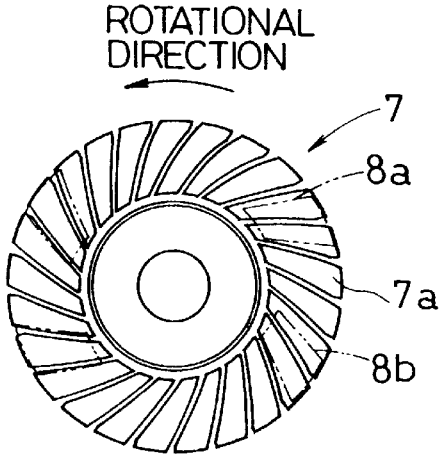
FIG. 2 is a front view showing a commutator of the starter, taken in an axial direction of the starter in the first embodiment.

The armature 6 is composed of a rotational shaft 14, an armature core 15 into which the rotational shaft 14 is inserted with force so that the armature core 15 rotates along with the rotational shaft 14, and an armature coil 16 attached to the armature core 15. The rotational shaft 14 is rotatably supported by inner circumferences of a cylindrical portion 9*a* of the end frame 9 and a cylindrical portion 5*b* of the front end wall 5*a* of the yoke 5 respectively through ball bearings 12 and 13. The above-described commutator 7 is provided on the axial end surface of the armature coil 16 in the axial direction thereof. As shown in FIG. 2, the commutator 7 is composed of a plurality of commutator pieces 7*a*, each of which is inclined from an inner diameter side to an outer diameter side so that the outer diameter side becomes a delay side in a rotational direction of the commutator 7 in comparison with the inner diameter side.

Figure 3:
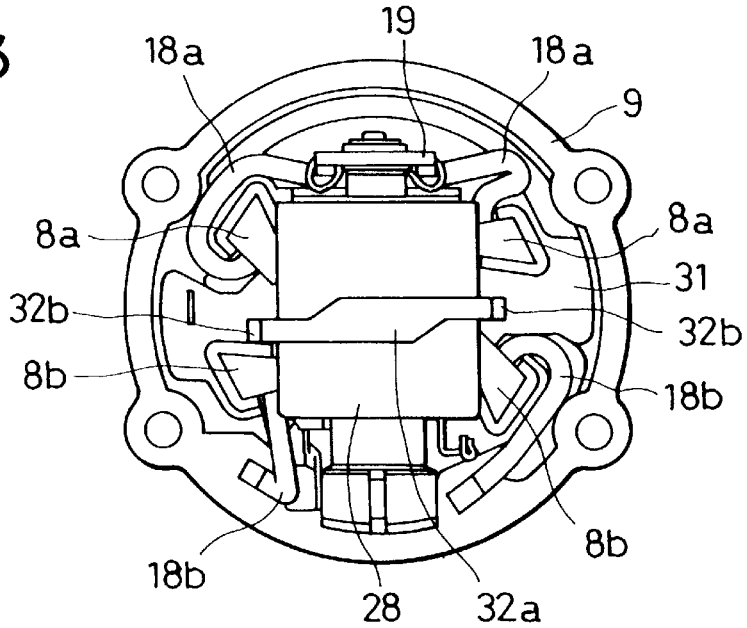
FIG. 3 is a rear view showing an internal structure of the starter in a state where an end cover of the starter is detached from the starter in the first embodiment.

The brushes 8 include positive electrode brushes 8*a* and negative electrode brushes 8*b*, which are respectively pushed to a commutator side by springs 17. The positive electrode brushes 8*a* are, as shown in FIG. 3, electrically connected to a moving contact 19 through leading wires 18*a*, and the negative electrode brushes 8*b* are electrically connected to the end frame 9 made of metal through leading wires 18*b* to be grounded. In a view taken in an axial direction of the armature 6, each of the brushes 8 has a shape having a width on the inner diameter side smaller than a width on the outer diameter side to correspond to the shape of the commutator pieces 7*a*, and is disposed on the commutator 7 to be inclined in the same way as the commutator pieces 7*a* are inclined.

The power transmission part includes, as shown in FIG. 1, a planetary gear reduction device, an output shaft 20 that rotates in response to an output of the reduction device, a pinion gear 21 engaged with the output shaft 20 through a helical spline (not shown), a rotation restricting member 22 that restricts rotation of the pinion gear 21 to apply an advancing power to the pinion gear 21, and the like. The reduction device is composed of a sun gear 23 disposed on an end side of the rotational shaft 14 of the armature 6 opposite to the commutator 7, an internal gear 24 disposed on an outer circumference in a radial direction of the sun gear 23, and a plurality of planetary gears 25 interposed between the sun gear 23 and the internal gear 24 to be engaged with both of the gears 23 and 24. The output shaft 20 is disposed on a front side of the armature 6 (on a left side in FIG. 1) coaxially with respect to the rotational shaft 14, and rotates in accordance with revolution (rotation on the outer circumference of the sun gear 23) of the planetary gears 25.

Upon receiving the advancing power, the pinion gear 21 advances on the output shaft 21 along the helical spline to be engaged with the ring gear. The pinion gear 21 has a rotation restricting plate 26 on a rear end thereof. The rotation restricting plate 26 is integrally formed with the pinion gear 21 to have an outer diameter larger than that of the pinion gear 21 and a plurality of engagement grooves (not shown) on an outer circumference thereof.

The rotation restricting member 22 is held in a state capable of moving in upper and lower directions in FIG. 1, and usually pressed to the upper side by a return spring (not shown). When an operative force (a plunger attraction force) of the magnetic switch 3 is transmitted to the rotation restricting member 22 through a cord-like member 27, the rotation restricting member 22 moves in the lower direction in FIG. 1 against a pressing force of the return spring. Accordingly, an end portion 22*a* of the rotation restricting member 22, which protrudes toward a pinion gear side in an axial direction of the output shaft 20, is engaged with one of the engagement grooves formed on the outer circumference of the rotation restricting plate 26. As a result, the rotation of the pinion gear 21 is restricted. Then, when the operative force of the magnetic switch 3 disappears, the rotation restricting member 22 returns in the upper direction in FIG. 1 by a restoring force of the return spring.

The magnetic switch 3 is disposed on the rear side of the armature 6 (on the right side in FIG. 1) such that a moving direction of a plunger 30 of the magnetic switch 3 crosses the axial direction of the armature 6 generally at right angles, and is covered with the end cover 11. The magnetic switch 3 has a yoke 28 having a cylindrical shape, a coil 29 held on the inner circumference of the yoke 28, the plunger 30 slidably disposed on the inner circumference of the coil 29, and the like.

An end of the coil 29 is connected to a switch terminal (not shown) that is connected to a key switch of a vehicle, and the other end of the coil 29 is connected to the end frame 9 to be grounded. An end of the code-like member 27 is connected to an end portion 22*b* of the rotation restricting member 22 and the other end of the code-like member 27 is connected to the bottom portion of the plunger 30. By energizing the coil 29 to produce a magnetic force, the plunger 30 is moved to the upper side in FIG. 1 by the magnetic force. Then, when the supply of electricity to the coil 29 is stopped so that the magnetic force disappears, the plunger 30 is moved to the lower side in FIG. 1 by the restoring force of the return spring transmitted through the code-like member 27.

On the other hand, a motor contact provided in a motor circuit is opened and is closed in accordance with the movement of the plunger 30. The motor contact is composed of a fixed contact 34 integrally formed with a power source terminal 33 and the moving contact 19 attached to a rod 35 fixed to the plunger 30 via an insulating member 36. The power source terminal 33 protrudes from the end cover 11 and is fixed to the end cover 11 by a washer 37 at the outside of the end cover 11. Further, the power source terminal 33 is connected to a battery through a cable (not shown). The fixed contact 34 is disposed to face the moving contact 19 within the end cover 11. The moving contact 19 is pushed toward a side opposite to the plunger 30 (upper side in FIG. 1) by a contact pressure spring 38 installed on the outer circumference of the rod 35.

Figure 4:
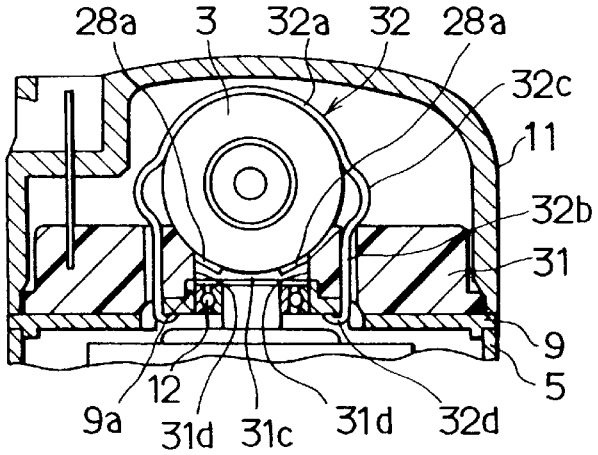
FIG. 4 is a cross-sectional view taken along a IV—IV line in FIG. 1, showing a fixing structure of a magnetic switch of the starter in the first embodiment.

As shown in FIGS. 1 and 3 to 5, the yoke 28 is fixed to a switch supporting member 31 and to the end frame 9 by a fixing member 32 while being supported by the switch supporting member 31. The switch supporting member 31 is made of resin and is also fixed to the end frame 9. Specifically, the switch supporting member 31 has engagement walls 31*a* and 31*b* (FIG. 1) that are provided in a protruding state on both end sides in the axial direction of the yoke 28. The engagement walls 31*a* and 31*b* restrict the movement of the magnetic switch 3 in the axial direction of the magnetic switch 3, thereby holding the magnetic switch 3 in position. Further, as shown in FIG. 4, the switch supporting member 31 abuts the yoke 28 at least at two portions, and partially has a non-abutting portion 31*c* having engagement walls 31*d* formed inside thereof. Further, the yoke 28 has protrusions 28*a* partially protruding to be engaged with the engagement walls 31*d* of the switch supporting member 31. By the engagement of the protrusions 28*a* and the engagement walls 31*d*, the movement in a circumferential direction (rotation) of the magnetic switch 3 is restricted. The switch supporting member 31 and the end frame 9 may be individually formed as individual parts, and may be integrally formed by an outsert molding or the like.

Figure 5A:
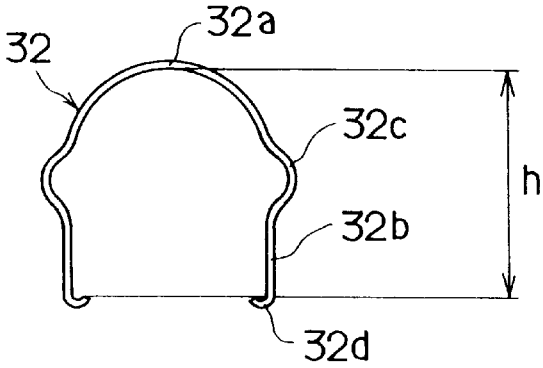
FIGS. 5A to 5C are explanatory views for explaining processes of fixing the magnetic switch to an end frame by a fixing member in the first embodiment.

The above-described fixing member 32 is made of material such as stainless steel having high elasticity and has a shape as illustrated in FIG. 5A. Specifically, the fixing member 32 is composed of a semi-circular portion (holding portion) 32*a* and arm portions 32 extending from the semi-circular portion 32*a*. The semi-circular portion 32*a* has a shape corresponding to the outer circumference of the yoke 28 and has an arc length sufficient for holding the yoke 28 at generally a half of the circumference of the yoke 28. Each of the arm portions 32*b* has a deflection portion 32*c* having elasticity at an end thereof on a semi-circular portion side and a claw portion 32*d* at the other end (front end) thereof. The deflection portions 32*c* are formed to protrude toward outside with respect to the arm portions 32*d* with an ark-like shape. The claw portions 32*d* are bent inwardly to be joined to the end frame 9. Here, a height h of the fixing member 32 shown in FIG. 5A between the inner circumference of the semi-circular portion 32*a* and front ends of the claw portions 32*d* is set to be slightly smaller than a height H shown in FIG. 5B between the outer circumference of the yoke 28 and the end surface of the end frame 9 at which the claw portions 32*d* are engaged.

As shown in FIG. 3, in a view taken from an end cover side (the right side in FIG. 1), the arm portions 32*b* of the fixing member 32 are eccentrically attached to the yoke 28 such that one of the arm portions 32*b* on the right side in FIG. 3 is arranged on the upper side and the other of the arm portion 32*b* on the left side in FIG. 3 is arranged on the lower side relative to each other. That is, the fixing member 32 is attached to the yoke 28 so that each of the arm portions 32*b* has the same interval with each of the positive electrode brushes 8*a*. This is because the positive electrode brushes 8*a* are inclined to correspond to the inclination of the commutator pieces 7*a*. That is, because the lowest positions of the positive electrode brushes 8*a* on the right and left sides in FIG. 3 are different from each other, the arm portions 32*b* of the fixing member 32 are eccentrically disposed to ensure a specific insulating distance between the positive electrode brushes 8*a* and the fixing member 32 that is electrically connected to an earth member.

Next, operation of the starter 1 in this embodiment will be explained. When the key switch of the vehicle is turned on to energize the coil 29 of the magnetic switch 3, a magnetic force is produced around the coil 29. The magnetic force moves the plunger 30 toward the upper side in FIG. 1, and then the rotation restricting member 22 moves to the lower side due to the movement of the plunger 30 transmitted through the code-like member 27. As a result, the end portion 22*a* of the rotation restricting member 22 is engaged with one of the engagement grooves of the rotation restricting plate 26 to restrict the rotation of the pinion gear 21.

On the other hand, by the movement of the plunger 30, the rod 35 moves to the upper side so that the moving contact 19 fixed to the rod 35 abuts the fixed contact 34. Accordingly, the motor contact is closed, and current is supplied to the armature coil 16 to generate a torque in the armature 6. The torque of the armature 6 is reduced in the reduction device, and then is transmitted to the output shaft 20 so that the output shaft 20 rotates. Accordingly, the pinion gear 21 attempts to rotate, whereas the rotation of the pinion gear 21 is restricted by the rotation restricting member 22. Because of this, the torque of the output shaft 20 is applied to the pinion gear 22 through the helical spline as a thrust (a pushing force in the axial direction). Consequently, the pinion gear 21 advances on the output shaft 20 along the helical spline to be engaged with the ring gear. When the pinion gear 22 is completely engaged with the ring gear, the end portion 22*a* of the rotation restricting member 22 is detached from the engagement groove of the rotation restricting plate 26 and falls down on the rear end side of the rotation restricting plate 26. In this way, the rotation restriction relative to the pinion gear 22 is released. As a result, the rotation of the output shaft 20 is transmitted to the ring gear through the pinon gear 21 to rotate the ring gear, thereby starting the engine.

Thereafter, when the key switch is turned off to stop the supply of electricity to the coil 29, the force pulling the rotation restricting member 22 through the code-like member 27 (plunger suction force) disappears. Therefore, the rotation restricting member 22 returns to the initial position thereof (the position shown in FIG. 1) by the restoring force of the return spring, and the plunger 30 also moves to the lower side. At the same time, the end portion 22*a* of the rotation restricting member 22 preventing the retreat of the pinion gear 21 is detached from the rotation restricting plate 26, so that the pinion gear 21 returns to the rest position thereof by a restoring force of a spring 39 and a retreat force applied by the ring gear.

Figure 5B:
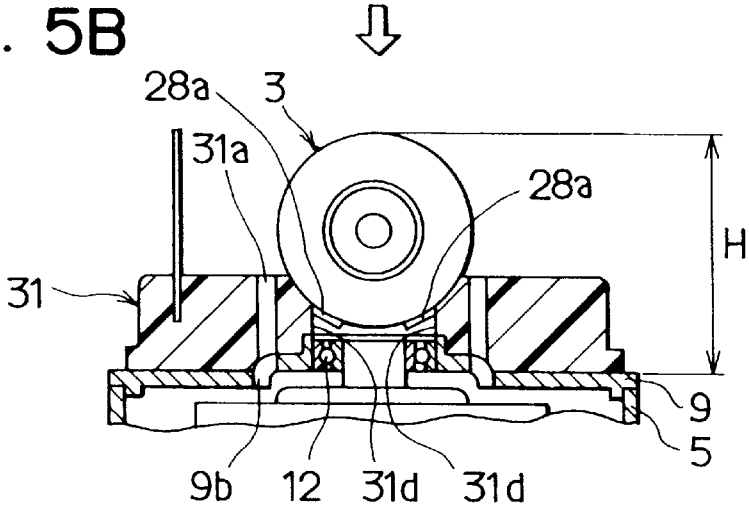
Figure 5C:
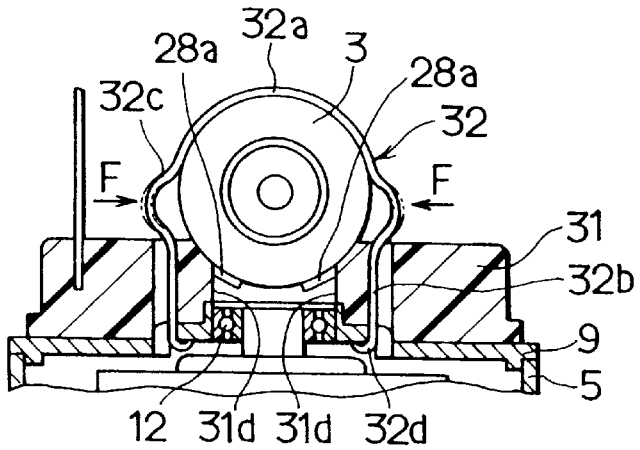

Next, a fixing method of the magnetic switch 3 by the fixing member 32 will be explained referring to FIGS. 5A to 5C. The arm portions 32*b* of the fixing member 32 are inserted into arm portion receiving holes 31*a* and 9*b* respectively formed in the switch supporting member 31 and in the end frame 9 as shown in FIG. 5B, and the semi-circular portion 32*a* is fitted to the outer circumference of the yoke 28. Here, as described above, the height H between the end of the yoke 28 and the end frame 9 in the vertical direction in FIG. 5C is slightly larger than the height h of the fixing member 32 shown in FIG. 5A. However, when attaching the fixing member 32 to the end frame 9, the deflection portions 32*c* are pushed inward from the outside, i.e., in directions indicated by arrows F in FIG. 5C to be elastically deformed, so that the height of the fixing member 32 can be increased. As a result, the claw portions 32*d* of the fixing member 32 can be engaged with the end surface of the end frame 9 as shown in FIG. 5C while providing elasticity to the deflection portions 32*c* of the fixing member 32.

The above-described embodiment has the following effects. According to this embodiment, by engaging the claw portions 32*d* of the fixing member 32 with the end surface of the end frame 9 while keeping the elasticity of the deflection portions 32*c* of the fixing member 32, the magnetic switch 3 can be fixed to the end frame 9 via the switch supporting member 31 in the state where the magnetic switch 3 is pushed by the fixing member 32 toward the end frame 9. As a result, the magnetic switch 3 can be easily fixed to the end frame 9 without any bolts. Further, the magnetic switch 3 can be easily dismounted from the end frame 9 only by detaching the claw portions 32*a* of the fixing member 32 from the end surface of the end frame 9. More specifically, the claw portions 32*a* of the fixing member 32 can be easily detached from the end frame 9 by pushing the deflection portions 32*c* of the fixing member 32.

In this embodiment, the magnetic switch 3 is fixed to the end frame 9 while being supported by the switch supporting member 31. In the starter 1 for a vehicle, because it is used in a high temperature atmosphere, there is a case that the switch supporting member 31 has creep in a long time use. In a conventional starter adopting a bolt fixing method for fixing the magnetic switch therein, because the occurrence of the creep changes the size of the switch supporting member, there is possibility that the fixing force for fixing the magnetic switch is reduced or disappears. However, according to the present invention, the change in size of the switch supporting member 31 caused by the creep can be absorbed by the deflection portions 32*c* of the fixing member 32, so that the fixing force of the fixing member 32 is not reduced. As a result, the fixing member 32 can securely fix the magnetic switch 3 to the end frame 9 even if the switch supporting member 31 has creep.

Figure 6:
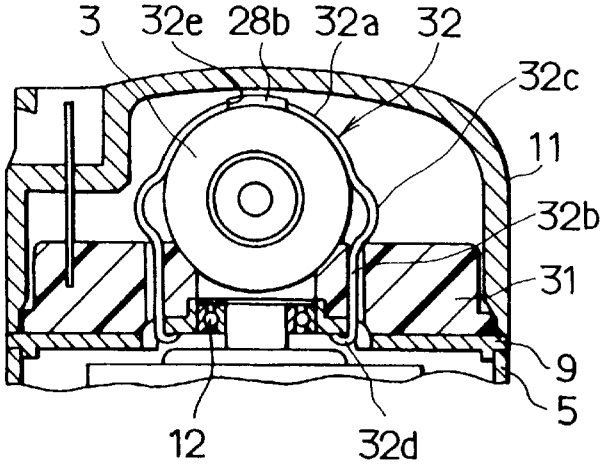
FIG. 6 is a cross-sectional view showing a fixing structure of a magnetic switch in a modified embodiment of the first embodiment.
Figure 7:
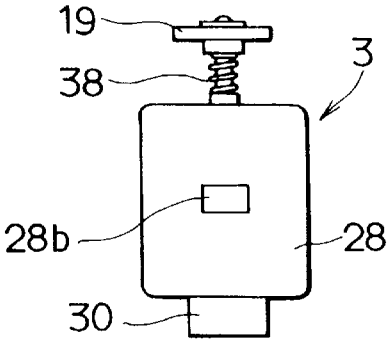
FIG. 7 is a plan view showing the magnetic switch taken from an upper side in FIG. 6 in the modified embodiment of the first embodiment.
Figure 8:
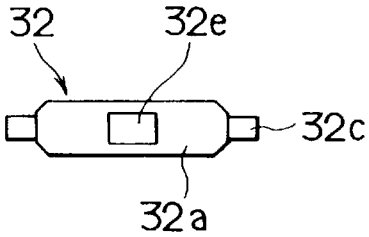
FIG. 8 is a plan view showing a fixing member taken from the upper side in FIG. 6 in the modified embodiment of the first embodiment.

In this embodiment, the movement in the circumferential direction (rotation) of the magnetic switch 3 is prevented by the protrusions 28*a* of the yoke 28 and the engagement walls 31*d* of the switch supporting member 31. However, as shown in FIG. 6, the rotation of the magnetic switch 3 may be prevented by using a protrusion 28*b* of the yoke 28 (FIG. 7) and an engagement hole 32*e* formed in the semi-circular portion 32*a* of the fixing member 32 (FIG. 8) for receiving the protrusion 28*b* of the yoke 28.

Second Embodiment

Figure 9:
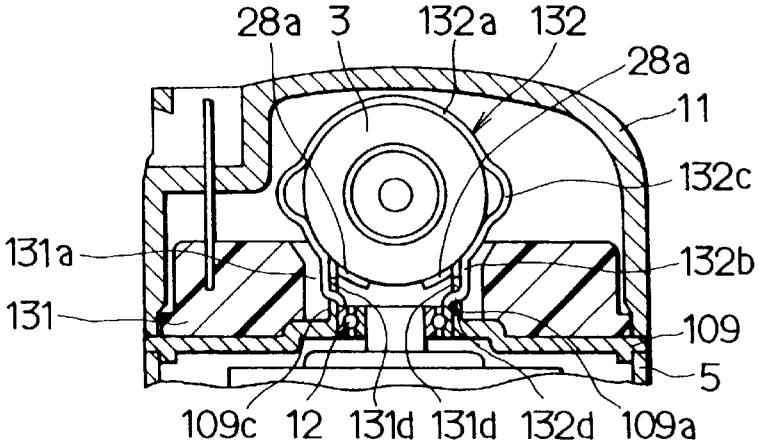
FIG. 9 is a cross-sectional view showing a fixing structure of a magnetic switch in a second preferred embodiment according to the present invention.

In a preferred second embodiment, an end frame 109, a switch supporting member 131, and a fixing member 132 are adopted in place of the end frame 9, the switch supporting member 31, and the fixing member 32 in the first embodiment. The other features are the same as those in the first embodiment. Specifically, as shown in FIG. 9, the end frame 109 has a cylindrical portion 109*a* for holding the ball bearing 12 and the cylindrical portion 109*a* is extended toward the magnetic switch side. Further, engagement holes 109*c* are formed in the extended portion of the cylindrical portion 109*a* to be engaged with claw portions 132*d* of the fixing member 132. Arm portions 132*b* of the fixing member 132 respectively have a length shorter than that in the first embodiment and sufficient for permitting the claw portions 132*d* to be engaged with the engagement holes 109*c* of the end frame 109 while providing elasticity to deflection portions 132*c* of the fixing member 132. The claw portions 132*d* bent inward respectively have front end portions further bent toward the opposite side of a semi-circular portion 132*a*. The switch supporting member 131 has arm receiving holes 131*a* for receiving the arm portions 132*b* of the fixing member 132 and engagement walls 131*d* for engaging with the protrusions 28*a* of the yoke 28 as in the first embodiment.

Because of this construction, in the state where the fixing member 132 is fixed to the end frame 109, the ends of the claw portions 132*d* abut the ball bearing 12 to push the ball bearing 12 in the axial direction of the armature 6 toward the armature 6. Accordingly, pressure can be applied to the ball bearing 13 disposed on the pinion gear side as well as to the ball bearing 12 disposed on the magnetic switch side in the axial direction of the armature 6, so that an impact load applied to the ball bearings 12 and 13 caused by vibrations and the like can be reduced. As a result, fatigue of the ball bearings 12 and 13 can be decreased, resulting in improvement of lifetime of the ball bearings 12 and 13. In addition, in this case, it is not necessary to employ another parts such as a conical spring, a waveshape washer, or the like for applying pressure to the ball bearings 12 and 13, resulting in low cost by decrease of number of parts.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter comprising:

a starter motor that includes an armature having a rotational shaft and generates a rotational force to rotate the armature;

a magnetic switch disposed on an end of the rotational shaft of the armature and including a coil that generates a magnetic force when energized and a plunger that moves in accordance with the magnetic force in a plunger moving direction, the plunger moving direction being perpendicular to the rotational shaft of the armature;

an end frame disposed between the starter motor and the magnetic switch; and a fixing member disposed on a magnetic switch side with respect to the end frame and fixing the magnetic switch to the end frame while pushing the magnetic switch toward the end frame, the fixing member including a holding portion for holding an outer circumference of the magnetic switch on an opposite side of the end frame with respect to the magnetic switch, an arm portion extending from the holding portion toward the end frame and detachably engaged with the end frame at a front end thereof, and a deflection portion provided between the holding portion and the arm portion to have elasticity.

2. The starter according to claim 1, wherein the arm portion of the fixing member has the deflection portion.

3. The starter according to claim 1, further comprising a resin member disposed between the end frame and the magnetic switch, wherein the fixing member fixes the magnetic switch to the end frame via the resin member.

4. The starter according to claim 3, wherein:

the resin member and the end frame respectively have holes for receiving the arm portion of the fixing member.

5. The starter according to claim 3, wherein at least one of the end frame, the resin member, and the fixing member has a restricting portion that restricts movement of the magnetic switch in an axial direction of the magnetic switch.

6. The starter according to claim 3, wherein at least one of the end frame, the resin member, and the fixing member has a restricting portion that restricts movement of the magnetic switch in a circumferential direction of the magnetic switch.

7. The starter according to claim 6, wherein:

the magnetic switch has a protrusion protruding toward the resin member; and the resin member has a recess that is engaged with the protrusion to prevent the rotation of the magnetic switch.

8. The starter according to claim 6, wherein:

the magnetic switch has a protrusion protruding in a radial direction thereof; and the holding portion of the fixing member has a hole for receiving the protrusion to prevent the rotation of the magnetic switch.

9. The starter according to claim 1, further comprising a ball bearing disposed on the end of the rotational shaft of the armature to face the end frame and supporting the rotational shaft of the armature, wherein the arm portion of the fixing member engaged with the end frame abuts the ball bearing at the front end thereof to push the ball bearing in an axial direction of the armature.

10. The starter according to claim 1, wherein:

the starter motor further including a commutator disposed at an end of the starter motor to face the end frame and positive and negative electrode brushes that slidably move on the commutator;

the arm portion of the fixing member includes a pair of arms; and a distance between one of the arms and the positive electrode brush is the same as that between the other of the arms and the positive electrode brush.

11. The starter according to claim 1, wherein the end frame has a hole for receiving the arm portion of the fixing member.

12. The starter according to claim 11, wherein the front end of the arm portion is bent to be engaged with the end frame.

13. The starter according to claim 1, wherein the holding portion of the fixing member has a semi-circular shape.

14. The starter according to claim 1, wherein the deflection portion of the fixing member protrudes outward with respect to the holding portion and the arm portion and is elastically deformed to have the elasticity.

15. The starter according to claim 14, wherein the deflection portion has an arc-like shape.

16. A starter comprising:

a starter motor that includes an armature and generates a rotational force to rotate the armature;

a magnetic switch disposed adjacent to the starter motor for controlling energization of the starter motor;

a partition member disposed between the starter motor and the magnetic switch; and a fixing member disposed on a magnetic switch side with respect to the partition member and fixing the magnetic switch to the partition member while pushing the magnetic switch toward the partition member, the fixing member including a holding portion for holding an outer circumference of the magnetic switch, an arm portion extending from the holding portion toward the partition member and detachably engaged with the partition member at a front end thereof, and a deflection portion provided between the holding portion and the arm portion to have elasticity.

17. The starter according to claim 16, wherein the deflection portion of the fixing member protrudes outward with respect to the holding portion and to the arm portion.

18. The starter according to claim 17, wherein the deflection portion of the fixing member has an arc-like shape.

19. The starter according to claim 16, wherein the fixing member has elastically deformed deflection portion to be detachably engaged with the partition member.

20. The starter according to claim 16, wherein the fixing member has elastically deformed deflection portion to fix the magnetic switch to the partition member while pushing the magnetic switch toward the partition member.

* * * * *